United States Patent [19]

Terracina

[11] 4,008,793

[45] Feb. 22, 1977

[54] TYPEWRITING MACHINE

[76] Inventor: Vittorino Terracina, Vicolo Andrea Doria No. 7, 00187 Rome, Italy

[22] Filed: Sept. 7, 1972

[21] Appl. No.: 286,944

[30] Foreign Application Priority Data

Sept. 8, 1971 Italy ..... 52755/71

[52] U.S. Cl. ..... 197/1 A; 197/102; 283/1 R

[51] Int. Cl.² ..... B41J 1/00

[58] Field of Search ..... 197/9, 11, 1 A, 100, 197/101, 102; 283/1, 17; D64/12; 35/2, 3, 4

[56] References Cited

UNITED STATES PATENTS

| | | | |
|---|---|---|---|
| 722,006 | 3/1903 | Fox | 197/102 |
| 1,021,189 | 3/1912 | Hill | 35/36 |
| 1,267,640 | 5/1918 | Eagelston | 283/17 |
| 1,718,694 | 6/1929 | Kurowski | 197/102 |
| 1,937,067 | 11/1933 | Parker | 197/101 |
| 2,455,443 | 12/1948 | Sarnoff | 197/4 |
| 2,526,633 | 10/1950 | Brumbaugh | 197/1 A |
| 2,923,393 | 2/1960 | Berkelmans | 197/9 |
| 3,020,995 | 2/1962 | Holt | 197/102 X;102 |
| 3,225,883 | 12/1965 | Ayres | 197/9 |
| 3,241,648 | 3/1966 | Stenudd | 197/1 R |
| 3,507,376 | 4/1970 | Kafafian | 197/11 |
| 3,539,723 | 11/1970 | Mattke | 197/1 R |
| 3,709,525 | 1/1973 | Frank | 283/1 |
| D198,607 | 7/1964 | Dickson, Jr. | D64/12 |

OTHER PUBLICATIONS

Herbert S. Zim, *Codes and Secret Writing,* c. 1948, pp. 29–32.

IBM Technical Disclosure Bulletin, R. A. Johnson, "Pushbutton Switch with no Moving Parts," vol. 13, No. 11, Apr. 1971.

*Primary Examiner*—Edgar S. Burr
*Assistant Examiner*—Paul J. Hirsch
*Attorney, Agent, or Firm*—Watson, Cole, Grindle & Watson

[57] ABSTRACT

A typewriter using an alphabet in which the letters are obtained from a single type of sign, the machine capable of being equipped with teletransmission and telereception devices, and means for use by the blind.

8 Claims, 14 Drawing Figures

A B C D E F G H I J K L M N O P Q R S T U V W X Y Z 1 2 3 4 5 6 7 8 9 0

Figures 1A, 1B, 1C, 1D, 2, 3A, 3B, 4A, 4B, 4C, 4D, 5, 6, 7:
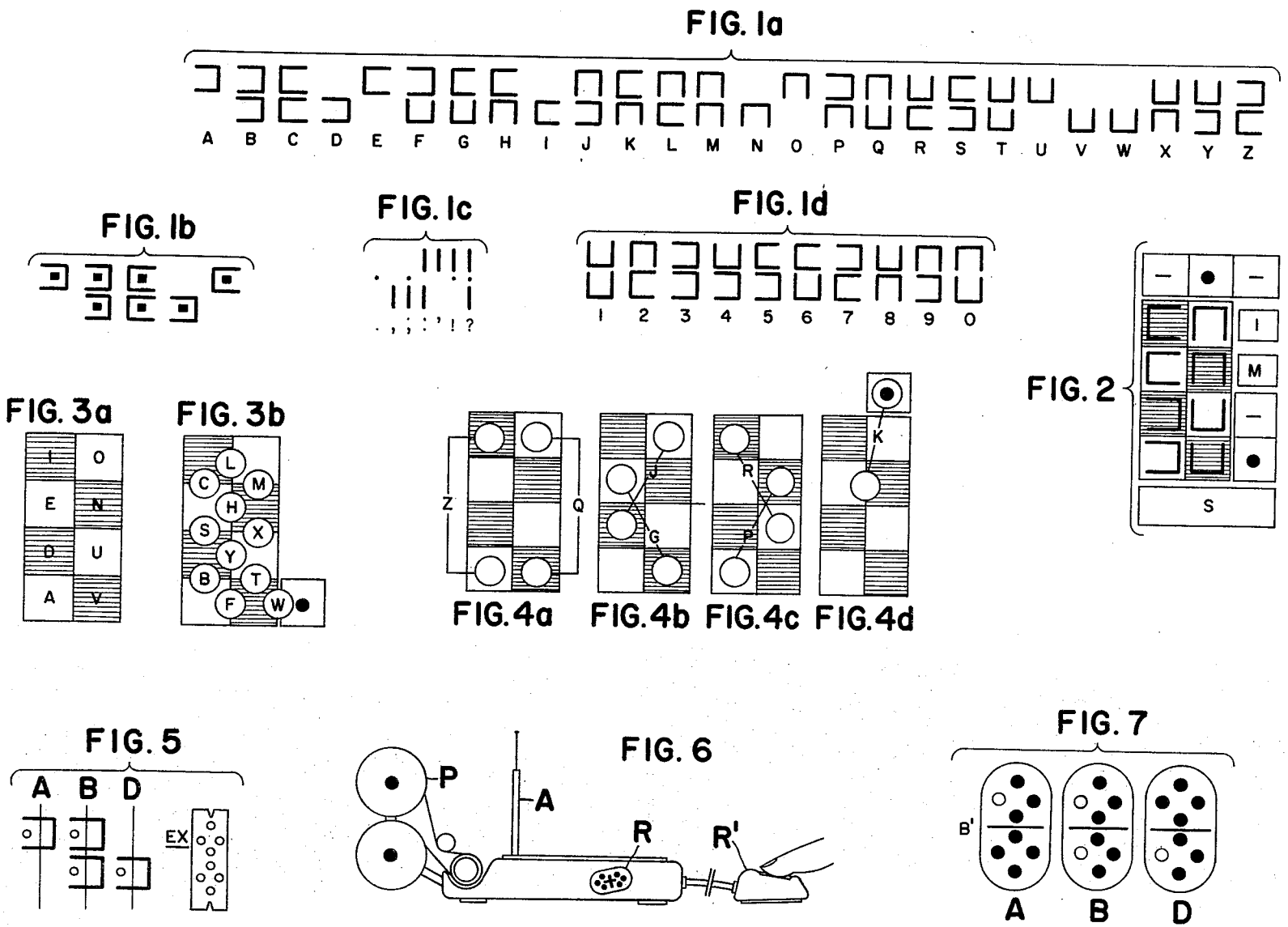

S
M

A B D
EX

P
A
R
R'

A B D
B'

TYPEWRITING MACHINE

The present invention relates to a typewriting machine wherein FIG. 1 characterizes the alphabet letters used with machine, FIGS. 2 to 4 characterize the keyboards for use with the machine, FIG. 5 characterizes the alphabet letters usable with a magnetic tape for the machine, FIG. 6 is a schematic illustration of the machine, and FIG. 7 characterizes the keys of a board further illustrating the invention.

The typewriting machine of the present invention is designed for writing using the alphabet in FIG. 1*a*, in which each letter is shaped as a single character having the shape of a square lacking a side or the shape resulting from different combinations of two squares each lacking a side.

The sign (having the shape of a square lacking a side) can assume four different orthogonal positions and can be placed at two different heights, above or below an imaginary line along the half-height of the typewritten line. Therefore, eight signs are provided for eight letters, which are all square letters, corresponding respectively with the letters representing in ordinary writing the five vowels and the consonants, D N V. Furthermore, combining the four positions of the sign above the imaginary line with the four positions of the same under the imaginary line yields 16 signs corresponding to other 16 letters.

Therefore from this new alphabet remains two letters K and W that will respectively be the same as H and V except that a point or an accent as shown in the FIG. 1*a* is added.

The typewriting machine designed for the use with the aforementioned alphabet presents therefore the feature of having a keyboard which includes only eight main rectangular keys, arranged in two vertical rows, side by side, each row including four keys as shown in FIG. 2. These keys are of two colors, and more precisely are four of one color and four of another color. In FIG. 2 these colors are respectively white and grey, since they correspond to the signs above the aforementioned imaginary line (letters A,E,D,U,) or to the signs under such line (letters D,I,N,V) as in FIG. 3. An appropriate device will prevent a simultaneous lowering of two keys having the same color.

In FIG. 2 is can be seen that as a consequence of such arrangement each key is surrounded by two or three keys of the other color so that by lowering two contiguous keys with one finger, it is possible to type ten bi-square letters. The ten finger locations of the operator are marked in FIG. 3*b* with encircled letters: C, S, B, L, H, Y, F, M, X, T.

The letter W is obtained by simultaneously lowering the keys with one finger for the letter V and for the side-key printing a point thereunder (FIG. 3*b*).

The remaining letters Z, Q, G, J, P and R are obtained by simultaneously with lowering, two fingers two non contiguous keys, as shown in the FIG. 4 (*a*, *b*, *c*). The manner of obtaining the letter K is shown in FIG. 4d by lowering three keys, using two fingers.

It is important to note that the letters which are typed using only one finger recur generally nine times out of ten.

Capital letters. Different shapes are not used for capital letters and for small letters using the aforedescribed alphabet. However, the small letters become capital letters using an inner sign as shown, in FIG. 1*b* for letters A, B, C, D, E. This special mark is obtained by lowering the key marked with the sign M in FIG. 2.

Numerals; As for numbers a simplified combination of the advantages of the old Roman notation system with that of the Arabian numeral system is used. The numbers are symbolized by the ten bi-square letters as in the manner shown in FIG. 1*d*. In general, there signs are differentiated by the phonetic ones because the lack of the vowels among the respective phonetic consonants symbolized by there signs do not allow their reading of the sequence of the phonetic signs. However, if needed, it is possible to obtain a differentiation between the use of the sign as a phonetic one and as numerical one, using a special inner sign typed by lowering the key M as in the case of the capital letters. In FIG. 2 there is always a horizontal long key to obtain spacing between two words.

Accents, punctuation, underlinings, etc.

In FIG. 2 it can be seen that above the eight keys used for typing the letters and the numbers are disposed three keys (coming from the left side) marked, respectively, with a dash, a point and again with a dash. Furthermore, on the right side of the eight letter-keys are two keys marked respectively (coming from the upper side) with a dash and a point. Therefore, using the last five named keys it is possible to obtain six kinds of accents and diacritical signs above and under the letters, seven kinds of punctuations, different underlinings and overlinings made using respectively only dashes, points, or any other wished combinations of dashes and points as follows:

Accents: Lowering a key with a finger, or simultaneously lowering, two keys it is possible to obtain: a dash ( — ), or a point ( . ), or a dash followed by a point ( — .); likewise it will be possible to obtain three other types of diacritical marks under the letters by lowering the two keys, which are on the right side of the eight main signs.

Punctuations: In this case, the three keys above the eight main keys are used by lowering one, two or all the three upper-keys using one, or two fingers. By lowering of key I using only one finger it is therefore possible obtain the following punctuation-signs: point, comma, semicolon, apostrophe, exclamation mark;

by using two fingers: two points and question mark.

Using the same keys it is also possible to obtain different types of underlinings and overlining with the use of a device which, as the finger remains pressed on the key, repeats the sign and allows the displacement of the paper-sheet for half the space-letter.

Telereceiver and teletransmitter

The letters of the abovedescribed alphabet may be identified as in FIG. 5 in a photoelectrical or a magnet electrical member (using a magnetic ink) through the use of a scanner acting only in the eight middle points of the open side of the elementar sign, or of the two elementary signs, representing the different letters and marked with the letters EX. For example, in FIG. 5, the two letters A and D are respectively identified through a point and viceversa the letter B through two points. A scanner, as foresaid, singles out each letter through one or two electric impulses.

Therefore, by connecting the typewriting-machine to a receiving or transmitting device, and starting from a text which is written using the aforedescribed alphabet, used for general purposes, messages (texts) may be directly transmitted and developed into a readable writing. Therefore, it is possible avoid the use of special codes and the need of the linear scanning of letters or numbers, or of the scanning of a great number of points for letters or numbers.

By including a receiving device allowing for the reception, through radio or wire of expressly transmitted messages, the typewriting machine of the present invention can be used twentyfour hours a day as a personal teletype machine and it can print news, without the need of an operator.

Of course, such teletype-machine can transmit messages within a short radius (or within a great radius, if, of course, connected with a suitable transmitting station).

In FIG. 6 the principal elements that feature the typewriting machine of the present invention are shown. The letter A on the drawing identifies an extractable antenna and the letter P identifies a device for the feeding of the paper needed for the telereception.

Use of the Machine of the invention by blind persons.

Writing. It is clear that, in consequence of the few keys and of their large surfaces, the position of the same can be easily identified by a blind operator. Furthermore the elementary signs which may be embossed can have different finishes on their surface, as for example a smooth one or a coarse one.

Reading. The reading may be obtained by scanning only eight points as in the case of the telewriting machine (cfr. the FIG. 5 EX), through a photo-magneto-electrical head, which will proceed to the analysis of each letter. The point or the two points, featuring with their position each letter, can be identified by touch of the blind person. Indeed, this tactile identification is easily obtained with the provision of one or two small rods extending outwardly of the bottom of a special seat, which may be sensed by the finger-tip placed at the side of the machine, as seen in FIG. 6 shown by the letter R. Also shown therein is a tactile reader R′ electrically connected with the machine. Of course, by connecting more readers of this type to one machine it is possible for more than one blind person to read the text.

In said FIG. 7, in which the finger-tip-seats are shown in full scale, clear small circles identify the one or two extending small rods 10, for the letters A, B, D.

Also in FIG. 7, it can be seen that a small bar, marked with the letter B′ coming out from the said seat for the finger-tip of the blind person, is placed in such a way as to be used as a reference for the identification of the position of the one point or of the two points from which the small rods extend. At the same time, such small bar, when lowered, allows the action of the scanning head and allows a change of the scanning at the next letter.

Fixed keyboard. As a consequence of the small number of keys and of their large surfaces, it is possible to control the printing device rather than using common devices which close and open the electrical circuits, by making use of the capacitive effect of the operators fingers; such effect being obtained only by contacting an insulating board in which are embedded conductor-plates. It is therefore possible do away with the usual movable keys and thereby obtain as a consequence a silent running device with less power consumption.

As an alternative, the operator's hand could operate the plates, so as to direct power radiated for this purpose directly from the machine having this power a convenient frequency and a short range. In such case, the machine can be limited to a pre-arranged frequency.

The invention is described and shown only by way of a non-limiting example. Therefore, it is to be understood that the invention is capable of all the variations that can be suggested by the technique and the practical applications, without departing from the spirit and the scope of the invention.

What I claim is:

1. A typewriter having a character associated with each of the alphabet letters and numerals thereof, said characters each being formed of the same sign oriented in one of four positions along coordinate horizontal and vertical axes and being located in one of two adjacent horizontal rows thereby being associated with several of said letters, said sign being also located in each of said rows one above the other thereby being associated with the remainder of said letters and said numerals, said sign having a right-angled and U-shaped configuration with three legs of equal length.

2. The typewriter according to claim 1 further having a keyboard of eight keys each having a sign thereon oriented in a predetermined position and being arranged into two adjacent vertical columns of four keys in each column, a first number of said keys corresponding to one of said horizontal rows and a second remaining number of said keys corresponding to the other of said horizontal rows, alternate ones of said first and said second keys being disposed on said keyboard, whereby a single key may be manually actuated and two adjacent keys may be manually actuated simultaneously for forming 90% of said letters and numerals, and whereby two non-adjacent keys may be manually actuated simultaneously for forming the remainder of said letters and numerals.

3. The typewriter according to claim 2 wherein said first keys are four in number and are of one color, and said second keys are four in number and are of another color to thereby identify the keys corresponding to each of said horizontal rows.

4. The typewriter according to claim 1 including an apparatus for transmitting messages with the use of a scanner mechanism for sensing said letters and numerals.

5. The typewriter according to claim 2 wherein said signs are provided in relief on their respective keys.

6. The typewriter according to claim 2 wherein said first keys are four in number and have a smooth outer surface, and said second keys are four in number and have a roughened outer surface to thereby identify the keys corresponding to each of said horizontal rows.

7. The typewriter according to claim 4, further comprising short rods, each arranged to extend through a respective opening and wherein said scanner causes said short rods to extend through their respective openings in relationship with said letters and numerals.

8. The typewriter according to claim 25 wherein a bar is provided for each of said signs for separating the rods corresponding to each of the horizontal rows of the typewriter.

* * * * *